US010323827B2

(12) United States Patent
Nauen et al.

(10) Patent No.: US 10,323,827 B2
(45) Date of Patent: Jun. 18, 2019

(54) LIGHTING APPARATUS

(71) Applicant: OSRAM GmbH, Munich (DE)

(72) Inventors: Andre Nauen, Regensburg (DE); David Dussault, Neutraubling (DE)

(73) Assignee: OSRAM GMBH, Munich (DE)

( * ) Notice: Subject to any disclaimer, the term of this patent is extended or adjusted under 35 U.S.C. 154(b) by 250 days.

(21) Appl. No.: 15/210,950

(22) Filed: Jul. 15, 2016

(65) Prior Publication Data

US 2017/0023209 A1 Jan. 26, 2017

(30) Foreign Application Priority Data

Jul. 22, 2015 (DE) ..... 10 2015 213 858

(51) Int. Cl.

| | |
|---|---|
| ***F21K 9/64*** | (2016.01) |
| ***F21V 7/22*** | (2018.01) |
| ***F21V 7/08*** | (2006.01) |
| ***F21S 41/37*** | (2018.01) |
| ***F21S 41/32*** | (2018.01) |
| ***F21S 41/16*** | (2018.01) |
| ***F21S 43/16*** | (2018.01) |
| *F21V 7/00* | (2006.01) |

(Continued)

(52) U.S. Cl.

CPC ..... *F21V 7/22* (2013.01); *F21K 9/64* (2016.08); *F21S 41/16* (2018.01); *F21S 41/32* (2018.01); *F21S 41/37* (2018.01); *F21S 43/16* (2018.01); *F21V 7/08* (2013.01); *F21V 7/0066* (2013.01); *F21W 2131/20* (2013.01); *F21W 2131/406* (2013.01); *F21Y 2115/30* (2016.08)

(58) Field of Classification Search

CPC . F21V 7/22; F21V 7/08; F21V 7/0066; F21K 9/64; F21Y 2115/30; F21S 41/37; F21W 2131/20; F21W 2131/406

See application file for complete search history.

(56) References Cited

U.S. PATENT DOCUMENTS 4,905,133 A * 2/1990 Mayer ..... F21V 7/22 362/346
2004/0119668 A1 6/2004 Homma et al.

(Continued)

FOREIGN PATENT DOCUMENTS

DE 2614770 A1 10/1976
DE 102007010719 A1 9/2008

(Continued)

OTHER PUBLICATIONS

German Search Report based on application No. 10 2015 213 858.5 (8 pages) dated Mar. 2, 2016 (Reference Purpose Only).

*Primary Examiner* — Bao Q Truong
(74) *Attorney, Agent, or Firm* — Viering, Jentschura & Partner MBB

(57) ABSTRACT

In various embodiments, a lighting apparatus is provided. The lighting apparatus includes a primary light generating device configured to generate a primary light beam, a phosphor body configured to at least partly convert the primary light beam into secondary light, and a shell-shaped reflector situated in a primary light path between the primary light generating device and the phosphor body. The reflector has in at least one part of its reflection surface a plurality of grooves which run openly in their longitudinal extent and which are arranged parallel to one another.

18 Claims, 2 Drawing Sheets

(51) Int. Cl.

| | |
|---|---|
| *F21Y 115/30* | (2016.01) |
| *F21W 131/20* | (2006.01) |
| *F21W 131/406* | (2006.01) |

(56) References Cited

U.S. PATENT DOCUMENTS

| | | | | |
|---|---|---|---|---|
| 2009/0034272 | A1* | 2/2009 | Gorres | F21V 7/04 362/346 |
| 2010/0084962 | A1 | 4/2010 | Winkler et al. | |
| 2012/0243205 | A1 | 9/2012 | Lin | |
| 2014/0218938 | A1 | 8/2014 | Ouderkirk et al. | |
| 2014/0327887 | A1 | 11/2014 | Wesseling et al. | |
| 2015/0098065 | A1* | 4/2015 | Tanaka | G03B 21/2013 353/84 |
| 2015/0145406 | A1 | 5/2015 | Li et al. | |
| 2015/0252964 | A1* | 9/2015 | Takahashi | F21K 9/60 362/84 |
| 2017/0108190 | A1* | 4/2017 | Hadrath | F21S 41/24 |

FOREIGN PATENT DOCUMENTS

| | | | |
|---|---|---|---|
| DE | 102012100446 | A1 | 9/2012 |
| DE | 102011089209 | A1 | 6/2013 |
| GB | 1481938 | A | 8/1977 |
| WO | 2007014371 | A2 | 2/2007 |

* cited by examiner

LIGHTING APPARATUS

CROSS-REFERENCE TO RELATED APPLICATION

This application claims priority to German Patent Application Serial No. 10 2015 213 858.5, which was filed Jul. 22, 2015, and is incorporated herein by reference in its entirety.

TECHNICAL FIELD

Various embodiments relate generally to a lighting apparatus having a primary light generating device for generating a primary light beam, a phosphor body for at least partly converting the primary light beam into secondary light and a shell-shaped reflector situated in a primary light path between the primary light generating device and the phosphor body. Various embodiments are applicable, for example, to the field of vehicle lighting, e.g. headlights, stage lighting, medical diagnosis and/or effect lighting.

BACKGROUND

It is conventional to radiate primary light having a predefined primary light wavelength (e.g. blue "primary" light) onto a wavelength-converting phosphor body, by which the primary light is at least partly converted into light having a higher wavelength (e.g. into yellow "secondary" light) and is emitted again. The phosphor body may be for example a ceramic body composed of rare-earth-doped ceramic having a garnet structure and be adhesively bonded by silicone adhesive for thermal and mechanical linking on a carrier. If the primary light is laser light and if the phosphor body is spaced apart from the laser generating the primary light, this is also referred to as an LARP ("Laser Activated Remote Phosphor") arrangement. In the case of the LARP arrangement, a (deflection) reflector is often provided in a primary light path between the laser and the phosphor body in order to deflect the primary light onto the phosphor body.

In this case, a homogenization of a density distribution of a radiation power or a radiation intensity of the primary light beam for an LARP application is worthwhile with regard to a photometric power and a lifetime. This applies e.g. to the case where organic materials are used in the laser beam path, for example the silicone adhesive for fixing the phosphor body. In the case of local peak values of the radiation intensity of a blue laser light beam of above 100 W/mm$^2$, it has been found, for example, that the stability of commercially available silicone-based adhesives is exceeded for a lifetime that is sufficient in practice.

In order to reduce the peak values of the power density or the radiation intensity of the laser light beam, optical transmitted-light elements such as an integrator or a fly's eye lens can be introduced into the beam path of the laser light beam upstream of the phosphor body. However, a homogenization achievable in this way may still not suffice.

SUMMARY

In various embodiments, a lighting apparatus is provided. The lighting apparatus includes a primary light generating device configured to generate a primary light beam, a phosphor body configured to at least partly convert the primary light beam into secondary light, and a shell-shaped reflector situated in a primary light path between the primary light generating device and the phosphor body. The reflector has in at least one part of its reflection surface a plurality of grooves which run openly in their longitudinal extent and which are arranged parallel to one another.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
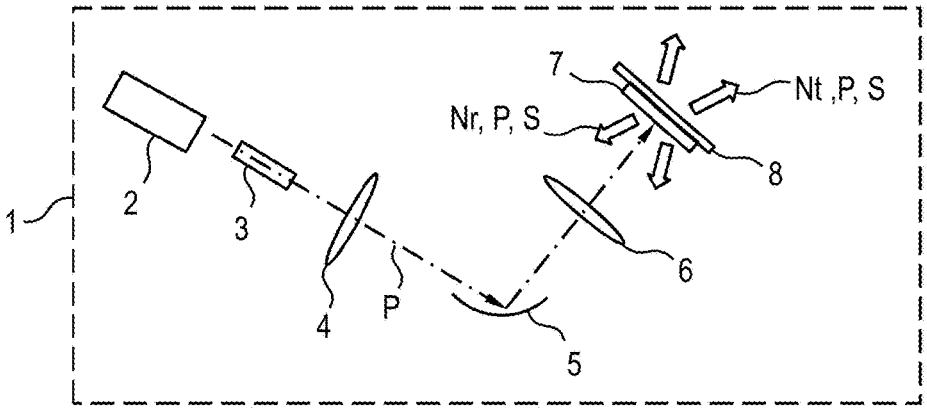
FIG. 1 shows a schematic diagram of a lighting apparatus including a reflector.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments at least partly overcome the disadvantages of the prior art and may provide e.g. a lighting apparatus which enables a particularly effective homogenization of a radiation intensity of the primary light beam even in the case of a small structural space that is available, with means that are implementable in a simple manner.

Various embodiments provide a lighting apparatus including a primary light generating device for generating a primary light beam, a phosphor body for at least partly converting the primary light beam into secondary light and a shell-shaped reflector situated in a primary light path between the primary light generating device and the phosphor body. The reflector has in at least one part of its reflection surface for the primary light beam a plurality of grooves which run openly in their longitudinal extent and which are arranged parallel to one another.

This lighting apparatus may afford the effect that, by means of the grooves, the primary light beam deflected by the reflector onto the phosphor body is reflected locally slightly differently and is thereby homogenized even further. For the homogenization the grooves bring about in particular an effect similar to a light deflection by an optical grating. Consequently, peaks of a luminance of the primary light beam can be reduced, which may have an effect on the photometric power and the lifetime of the lighting apparatus, e.g. in conjunction with inorganic materials.

The primary light generating device may include at least one primary light source. In one development, the at least one primary light source includes at least one semiconductor light source. The at least one semiconductor light source may include for example at least one light emitting diode and/or at least one laser diode.

For the case where the primary light generating device includes a plurality of light sources, the latter may radiate their individual light beams onto the reflector in a manner concentrated indistinguishably or in parallel fashion. Alternatively, the light sources may radiate their individual light beams onto the reflector at an angle with respect to one another.

The primary light beam may include primary light having one or more wavelengths, e.g. as a combination of individual light beams having different wavelengths. By way of example, the primary light beam may include ultraviolet light or blue light having exactly one wavelength, or alternatively ultraviolet light and/or blue light having different wavelengths.

The phosphor body may be configured for partly converting the primary light ("partial conversion") or for completely converting the primary light ("full conversion").

The phosphor body may include one or a plurality of phosphors. If a plurality of phosphors are present, they can generate secondary light having mutually different wavelengths. The wavelength of the secondary light may be longer (so-called "down conversion") or shorter (so-called "up conversion") than the wavelength of the primary light. By way of example, blue primary light can be converted into green, yellow, orange or red secondary light by means of a respective phosphor. In the case of only partial wavelength conversion, the phosphor body emits a mixture of secondary light and non-converted primary light, which mixture can serve as useful light. By way of example, white useful light can be generated from a mixture of blue, non-converted primary light and yellow secondary light. However, a full conversion is also possible, in the case of which either the primary light is no longer present in the useful light or only a negligible proportion of the primary light is present in the useful light. A degree of conversion is dependent on a thickness and/or a phosphor concentration, for example. If a plurality of phosphors are present, secondary light portions having different spectral compositions can be generated from the primary light, e.g. yellow and red secondary light. The red secondary light can be used for example to give the useful light a warmer hue, e.g. so-called "warm-white". If a plurality of phosphors are present, at least one phosphor may be suitable for wavelength-converting secondary light again, e.g. green secondary light into red secondary light. Such a light wavelength-converted again from a secondary light may also be referred to as "tertiary light".

In another development, the lighting apparatus includes at least one further light source for generating at least one further light beam (referred to as "neutral light beam" hereinafter, without restricting the generality). Such a lighting apparatus is designed also to radiate the at least one neutral light beam via the reflector onto the phosphor body. In contrast to the primary light beam, the light of the neutral light beam cannot be wavelength-converted or converted by the phosphor body, but rather can be scattered by the phosphor body. This development makes it possible in a simple manner to admix a light beam with the useful light emitted by the phosphor body. As a result, a cumulative color locus of the useful light can be set in a simple manner. The at least one neutral light beam can be guided analogously to the individual primary light beams, e.g. parallel thereto, in a manner indisguishably concentrated therewith or at an angle with respect to the individual primary light beams. The neutral light beam may be a red light beam, for example.

The lighting apparatus can operate the phosphor body in a transmissive arrangement in which useful light is emitted by the phosphor body at the side facing away from the irradiation surface. Additionally or alternatively, the lighting apparatus can operate the phosphor body in a reflective arrangement in which useful light is emitted by the phosphor body at the side that also has the irradiation surface.

A shell-shaped reflector is understood to mean, for example, a reflector which has a three-dimensionally curved reflection surface at least in a region at which the primary light beam impinges. The three-dimensionally curved reflection surface may be for example an elliptically paraboloidal, a spherical or a freeform basic shape. In one configuration, therefore, at least the part of the reflection surface of the reflector that has the grooves has a shell-shaped basic shape.

A groove is understood to mean, for example, an elongate depression. The (track) breadth or (track) width thereof between the two side edges may be determined e.g. perpendicular to the longitudinal extent. An (insertion) depth of a groove may be determined in particular in relation to the basic shape of the reflection surface of the reflector without a groove. This may at least approximately correspond to a distance between a plane drawn up through the side edges of the groove and the deepest point of the groove with respect thereto.

A groove running openly in its longitudinal extent is understood to mean, for example, a groove which has open ends and is not circumferentially closed. In this regard, a groove that is ring-shaped in a closed fashion is not an openly running groove. In one development, the ends of at least one openly running groove—for example of all the openly running grooves—reach as far as the edge of the shell-shaped reflection surface.

Grooves arranged parallel to one another are understood to mean, for example, adjacent grooves which on the longitudinal side directly adjoin one another or whose longitudinal edges facing one another are at a constant distance from one another.

In one development, the grooves are at least approximately rectilinear. A rectilinear groove can be understood to mean, for example, a groove whose projection onto a plane can produce a straight line.

In another configuration, a track width, an insertion depth and/or a deflection angle of the grooves are/is identical. This enables a particularly simple design and production.

A deflection angle can be understood to mean an (for example mean or average) angle, as viewed in the cross section of the groove, by which a primary light beam impinging on the groove is emitted in an angle-offset manner, to be precise in comparison with an imaginary grooveless basic shape of the reflection surface there. The deflection angle can therefore specify, for example, by what (in particular mean or average) angle dimension a primary light beam impinging on the groove is deflected more greatly or more weakly in comparison with a grooveless reflector.

In a further configuration, a track width and/or an insertion depth and/or a deflection angle of at least two adjacently arranged grooves are/is different. In this regard, an even greater homogenization can be achieved.

In one development, the grooves are arranged in a plurality of groups, which can improve a homogenization of the reflected primary light beam even further. The groups or adjacent grooves of different groups can directly adjoin one another or be spaced apart from one another.

In a further configuration, the grooves are arranged in a plurality of groups having in each case at least two different grooves, which enables an even greater homogenization. The groups can have grooves that are identical or similar to one another.

In one configuration, furthermore, the groups are arranged parallel to one another, which facilitates a design. By way of example, the groups can have in each case three parallel grooves R1, R2 and R3 having identical or different properties. The reflector surface therefore has in particular parallel grooves of the lateral succession R1-R2-R3-R1-R2-R3 etc.

In one general development for improving the homogeneity of the reflected primary light beam, at least two grooves can run at an angle with respect to one another and e.g. also cross one another. By way of example, such a gratinglike groove pattern can be produced on the reflection surface. Grooves running parallel to one another can be spaced apart or adjoin one another directly (without any spacing).

In yet another configuration, the track width, the insertion depth and/or the deflection angle of the grooves of a group are/is different in relation to a grooveless basic shape.

In one configuration, furthermore, the track width, the insertion depth and/or the deflection angle of the grooves of a group increase(s) or decrease(s) successively in adjacent succession. This enables a particularly simple configuration or a particularly simple design even of complex groove patterns.

By way of example, a first groove R1 may have a track width of approximately 4.9 micrometers, an insertion depth of approximately 15 nanometers and a deflection angle of approximately 0.7°. A second groove R3 (which is arranged adjacent to the first groove R1) may have a track width of approximately 5.9 micrometers, an insertion depth of approximately 25 nanometers and a deflection angle of approximately 0.85°. A third groove R3 (which is arranged adjacent to the second groove R2) may have a track width of approximately 7 micrometers, an insertion depth of approximately 30 nanometers and a deflection angle of approximately 1°.

This may provide for homogenizing a beam intensity.

Generally, it may be provided for the track width of the grooves to be between 2 micrometers and 200 micrometers.

Moreover, it may be provided for the deflection angle of the grooves to be between 0.25° and 5°, e.g. between 0.25° and 1°, and e.g. if the deflection angle of the grooves is between 0.5° and 1°.

Furthermore, it may be provided for the insertion depth of the grooves to be between 5 nanometers and 5 micrometers, e.g. between 10 nanometers and 100 nanometers, e.g. between 15 nanometers and 50 nanometers, e.g. between 15 nanometers and 30 nanometers.

A simple implementation may be achieved by the configuration in which a cross-sectional shape of the grooves is circle-sector-shaped. However, other cross-sectional shapes can also be used, e.g. an elliptic, hyperbolic or freeform shape.

A compact implementation may be achieved by the configuration in which a cross-sectional area of the primary light beam has a ratio to a projection—parallel thereto—of the part of the reflection surface that has the grooves of at least 25%. In other words, the primary light beam occupies at least 25% of the (projected) area of that part of the reflection surface which has the grooves.

In one configuration, moreover, a height of that part of the reflection surface which has the grooves and can be illuminated by the primary light beam is between five and ten millimeters, e.g. approximately six millimeters.

In another configuration, moreover, a maximum diameter of the primary light beam in the region of the reflector is between two and four millimeters, e.g. approximately three millimeters. A cross-sectional shape of the primary light beam may be for example circular, oval or angular (e.g. rectangular).

For further homogenization of the primary light beam, the lighting apparatus may include an integrator rod disposed upstream of the reflector. It may additionally or alternatively also include an integrator rod disposed downstream of the reflector.

What can be achieved by means of the above lighting apparatus is that—even in the case of a compact design—a local power density at the phosphor body is not more than 100 W/mm$^2$.

The lighting apparatus may be provided for the case where the phosphor body is fixed by means of an organic adhesive, e.g. silicone adhesive.

In one configuration, moreover, the lighting apparatus is a vehicle lighting apparatus. The vehicle lighting apparatus may be a headlight, e.g. having a low beam function, a high beam function, a fog light function, a daytime running light function and/or a cornering light function.

In another configuration, moreover, the lighting apparatus is a stage lighting apparatus, e.g. a stage spotlight.

In another configuration, moreover, the lighting apparatus is an effect lighting apparatus.

In one development, the lighting apparatus is a medical diagnosis lighting apparatus.

FIG. 1 shows a schematic diagram of a lighting apparatus 1, which may be a part of a headlight/spotlight (e.g. of a vehicle headlight, of a stage spotlight, etc.), of an effect lighting system, of an exterior lighting system, etc.

The lighting apparatus 1 includes a primary light generating device 2 in the form of at least one laser 2 which can emit a primary light beam P in the form of an e.g. blue laser beam. The primary light beam P, for its homogenization, passes through an integrator rod 3 and, if appropriate, an optical unit 4 (including one or more optical elements), before it is incident on a (deflection) reflector 5. From the reflector 5 the primary light beam P is radiated, if appropriate via a further optical unit 6, onto an e.g. ceramic phosphor body 7. The phosphor body 7 can be fixed to a carrier 8 by means of an organic adhesive (not illustrated).

The useful light emitted by the phosphor body 7 can be emitted in a reflective arrangement as useful light Nr from the same side of the laminar phosphor body 7 on which the primary light beam P is also incident. In this case, the carrier 8 may be embodied e.g. in a reflective fashion. The useful light emitted by the phosphor body 7 can be emitted in a transmissive arrangement as useful light Nt from that side of the laminar phosphor body 7 which faces away from the side on which the primary light beam P is incident. In this case, the carrier 8 may be in particular light-transmissive, e.g. a sapphire lamina. The useful light Nr, Nt may be for example a mixture of primary light P which has not been wavelength-converted (but rather scattered) at the phosphor body 7 and secondary light S that has been wavelength-converted at the phosphor body 7. If the secondary light S is yellow light, the useful light Nr, Nt is, for example, blue-yellow or white mixed light.

Figure 2:
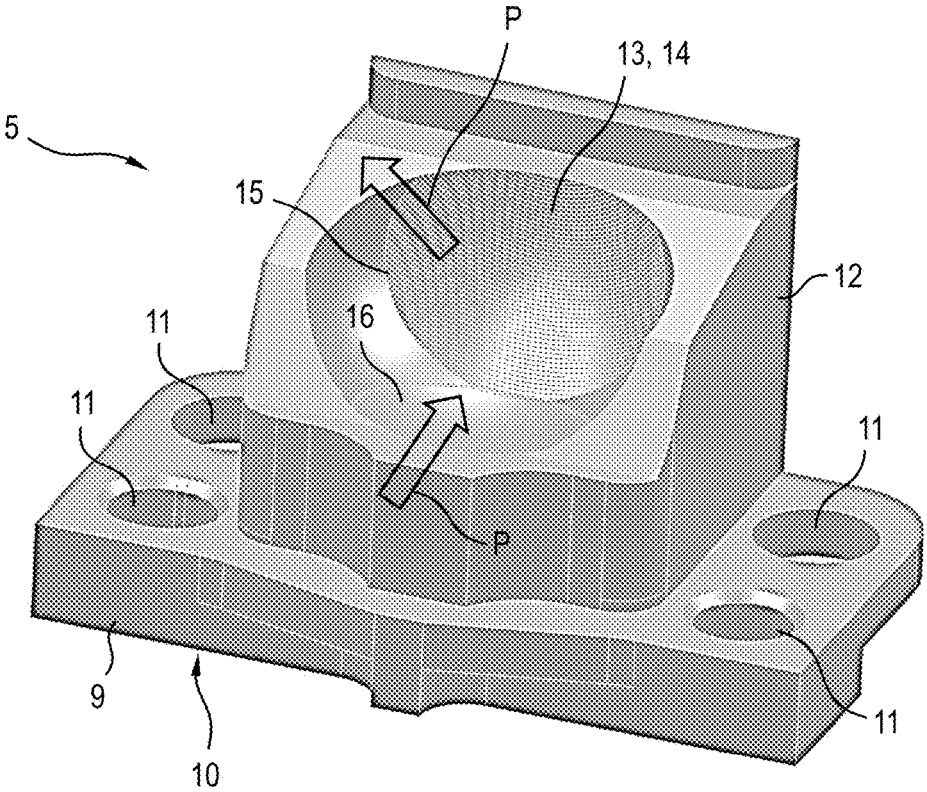
FIG. 2 shows an oblique view of a reflector of the lighting apparatus.

FIG. 2 shows the reflector 5 in an enlarged oblique view. The reflector has a base 9, at the underside 10 of which the reflector 5 can be placed onto a support (not illustrated). The reflector 5 can be fixed to the support via holes 11. The underside 10 may be regarded hereinafter as being oriented horizontally or lying in a horizontal H (see FIG. 3), without restricting the generality.

A reflector region 12 projects upward from the base 9, a reflection surface 13 for the primary light beam P incident horizontally here from the primary light generating device 2 being embodied at said reflector region. At the reflection surface 13 the primary light beam P is deflected in the direction of the phosphor body 7. The incident primary light beam P has such a large cross section (e.g. of three millimeters) that it occupies at least 25% of the reflection surface 13, e.g. at least 25% of a projection of the reflection surface 13 onto a (here: vertical) projection plane E oriented perpendicular to the primary light beam P (see FIG. 3). The reflection surface 13 may have for this purpose for example a vertical height of approximately six millimeters.

The reflection surface 13 has a basic shape which is ellipsoidal in a shell-shaped fashion and into which are introduced a plurality of openly running grooves 14 arranged parallel to one another. By way of example, the entire reflection surface 13 is provided or structured with grooves 14. The grooves 14 have ends that reach to the edge 15 of the reflection surface 13. The grooves 14 are arranged one above another horizontally here.

The reflector region 12 furthermore has a further shell-shaped reflection surface 16 arranged below the reflection surface 13. The further reflection surface 16 cannot be irradiated directly by the primary light beam P, but rather serves to reflect back again mixed light P, S emitted by the phosphor body 7, since otherwise it would be lost. The further reflection surface 16 has a smooth (non-structured), e.g. spherically shaped or freeform shaped surface.

Figure 3:
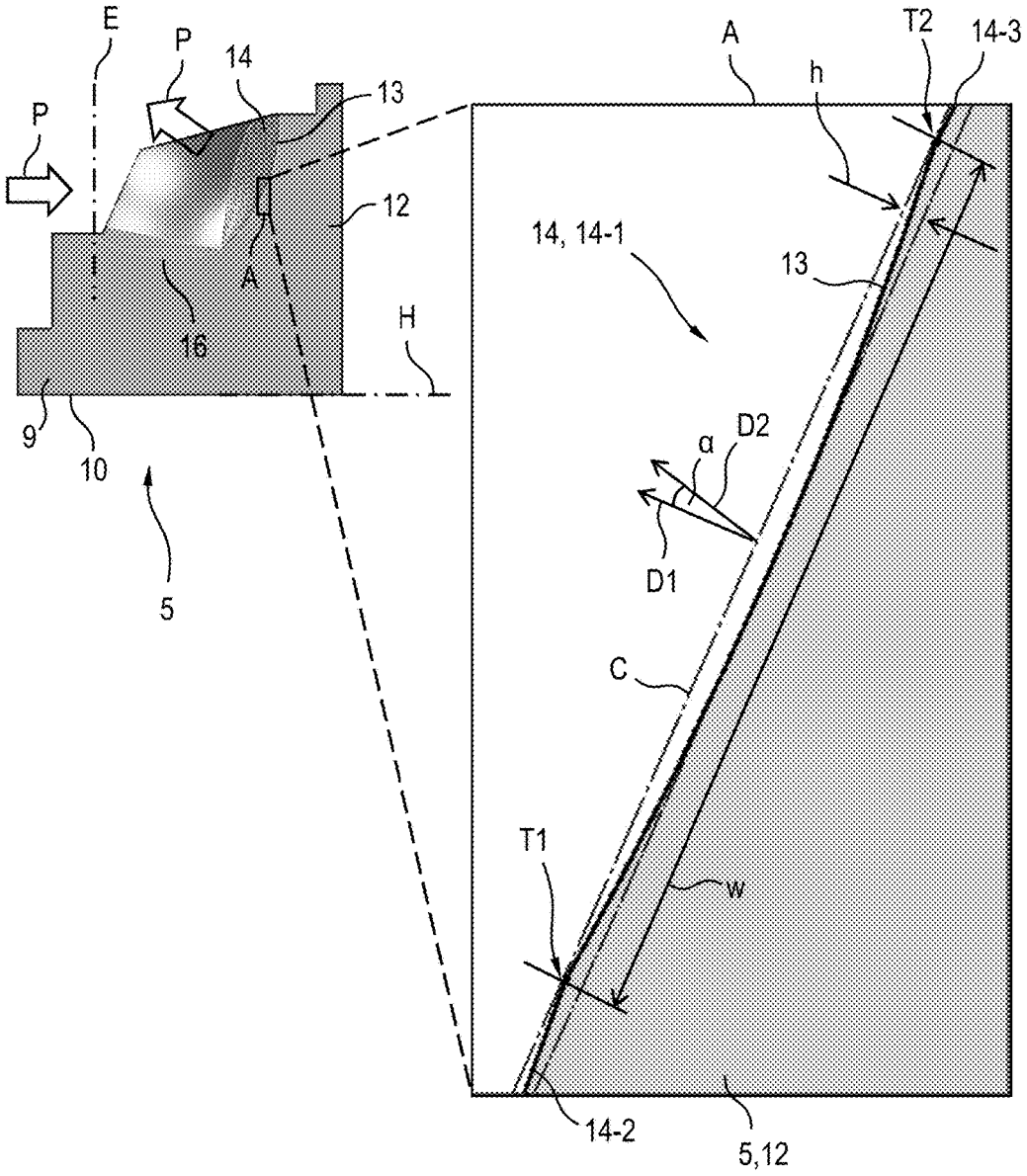
FIG. 3 shows the reflector as a sectional illustration in side view with an enlarged excerpt.

FIG. 3 shows the reflector 5 as a sectional illustration in side view with an enlarged excerpt A. A specific groove 14-1 from the grooves 14 is depicted in cross section in the excerpt A. The groove 14-1 has e.g. a shape of a circle sector in cross section. In comparison with a non-structural ellipsoidal surface C it has a track width w between its two side edges T1 (lower side edge) and T2 (upper side edge). A further groove 14-2 is adjacent to the lower side edge T1 without any spacing, and yet another groove 14-3 is adjacent to the upper side edge T2 without any spacing.

The groove 14-1 furthermore has, as a characteristic variable, a maximum insertion depth h in comparison with the non-structured surface C.

Moreover, the groove 14-1 can be characterized by a deflection angle α, which specifies an angle difference between an emission direction D1 of the primary light beam P from the non-structured surface C and an emission direction D2 of the primary light beam P from the groove 14-1.

In the case of a circle-sector-shaped cross-sectional shape, the groove 14-1 may for example also be determined by a radius (not illustrated) of an associated circle.

In one development, the track width w may be between 2 micrometers and 200 micrometers and/or the deflection angle α may be between 0.5° and 5° and/or the insertion depth h may be between 5 nanometers and 5 micrometers, e.g. between 10 nanometers and 100 nanometers, e.g. between 15 nanometers and 50 nanometers, e.g. between 15 nanometers and 30 nanometers.

A radius may be e.g. between 0.15 millimeter and 1 millimeter.

In one development, all the grooves 14-1, 14-2, 14-3 may have the same track width w, insertion depth h and/or deflection angle α.

In another development, the track width w, the insertion depth h and/or the deflection angle α of at least two grooves 14-1, 14-2, 14-3 may differ. By way of example, the grooves 14-1, 14-2, 14-3 can be arranged in a plurality of groups arranged parallel to one another. The characteristic values w, h, α etc. of the grooves 14-1, 14-2, 14-3 of different groups may be identical, but may be different within a group. In particular, the track width w, the insertion depth h and/or the deflection angle α of the grooves 14-1, 14-2, 14-3 of a group may increase or decrease successively in adjacent succession.

By way of example, the lower groove 14-2 may have a track width w of approximately 4.9 micrometers, an insertion depth h of approximately 15 nanometers and a deflection angle α of approximately 0.7°. The central groove 14-1 may have a track width w of approximately 5.9 micrometers, an insertion depth h of approximately 25 nanometers and a deflection angle α of approximately 0.85°. The upper groove 14-3 may have a track width w of approximately 7 micrometers, an insertion depth of approximately 30 nanometers and a deflection angle α of approximately 1°. However, the values may also be assigned in the opposite order. Further such groups may be adjacent below the groove 14-2 and/or above the groove 14-3.

Although the invention has been more specifically illustrated and described in detail by embodiments shown, nevertheless the invention is not restricted thereto and other variations can be derived therefrom by the person skilled in the art, without departing from the scope of protection of the invention.

Generally, "a(n)", "one", etc. can be understood to mean a singular or a plural, in particular in the sense of "at least one" or "one or a plurality", etc., as long as this is not explicitly excluded, e.g. by the expression "exactly one", etc.

Moreover, a numerical indication can encompass exactly the indicated number and also a customary tolerance range, as long as this is not explicitly excluded.

REFERENCE SIGNS

1 Lighting apparatus
2 Primary light generating device
3 Integrator rod
4 Optical unit
5 Reflector
6 Optical unit
7 Phosphor body
8 Carrier
9 Base
10 Underside
11 Hole
12 Reflector region
13 Reflection surface
14 Groove
14-1 Central groove
14-2 Lower groove
14-3 Upper groove
15 Edge of the reflection surface
16 Further reflection surface
A Excerpt
C Surface
D1 Emission direction
D2 Emission direction
E Projection plane
H Horizontal
h Insertion depth Nr Useful light in a reflective arrangement
Nt Useful light in a transmissive arrangement
P Primary light beam
S Secondary light
T1 Lower side edge
T2 Upper side edge
w Track width
α Deflection angle While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting apparatus, comprising
a primary light generating device configured to generate a primary light beam;
a phosphor body configured to at least partly convert the primary light beam into secondary light; and
a shell-shaped reflector situated in a primary light path between the primary light generating device and the phosphor body;
wherein the reflector has in at least one part of its reflection surface a plurality of grooves which run openly in their longitudinal extent and which are arranged parallel to one another;
wherein a cross-sectional area of the primary light beam has a ratio to a projection—parallel thereto—of the part of the reflection surface that has the grooves of at least 25%.

2. The lighting apparatus of claim 1,
wherein at least the part of the reflection surface of the reflector that has the grooves has an ellipsoidal basic shape.

3. The lighting apparatus of claim 1,
wherein at least one of a track width, an insertion depth or a deflection angle of the grooves are/is identical.

4. The lighting apparatus of claim 1,
wherein the grooves are arranged in a plurality of groups comprising in each case at least two different grooves; and
wherein the groups are arranged parallel to one another.

5. The lighting apparatus of claim 4,
wherein at least one of the track width, the insertion depth or the deflection angle of the grooves of a group are/is different in relation to a grooveless basic shape.

6. The lighting apparatus of claim 5,
wherein at least one of the track width, the insertion depth or the deflection angle of the grooves of a group increase(s) or decrease(s) successively in adjacent succession.

7. The lighting apparatus of claim 1,
wherein a track width of the grooves is between 2 micrometers and 200 micrometers.

8. The lighting apparatus of claim 1,
wherein a deflection angle of the grooves is between 0.5° and 5°.

9. The lighting apparatus of claim 1,
wherein a insertion depth of the grooves is between 5 nanometers and 5 micrometers.

10. The lighting apparatus of claim 9,
wherein the insertion depth of the grooves is between 10 nanometers and 100 nanometers.

11. The lighting apparatus of claim 10,
wherein the insertion depth of the grooves is between 15 nanometers and 50 nanometers.

12. The lighting apparatus of claim 11,
wherein the insertion depth of the grooves is between 15 nanometers and 30 nanometers.

13. The lighting apparatus of claim 1,
wherein a cross-sectional shape of the grooves is circle-sector-shaped.

14. The lighting apparatus of claim 1,
wherein a height of the part of the reflection surface that has the grooves is between five and ten millimeters.

15. The lighting apparatus of claim 1,
wherein a maximum diameter of the primary light beam in the region of the part of the reflector that has the grooves is between two and four millimeters.

16. The lighting apparatus of claim 14,
wherein a maximum diameter of the primary light beam in the region of the part of the reflector that has the grooves is approximately three millimeters.

17. The lighting apparatus of claim 1, further comprising:
an integrator rod disposed upstream of the reflector.

18. A lighting apparatus, comprising
a primary light generating device configured to generate a primary light beam;
a phosphor body configured to at least partly convert the primary light beam into secondary light; and
a shell-shaped reflector situated in a primary light path between the primary light generating device and the phosphor body;
wherein the reflector has in at least one part of its reflection surface a plurality of grooves which run openly in their longitudinal extent and which are arranged parallel to one another, and wherein at least one of a track width, an insertion depth, a deflection angle, or a combination thereof of at least two adjacently arranged grooves are/is different.

* * * * *